United States Patent [19]

Eller

[11] 4,009,474

[45] Feb. 22, 1977

[54] ALARM SYSTEM FOR ELECTRICAL RECEPTACLES

[76] Inventor: Chauncey B. Eller, 23100 Vista Grande Way, Colton, Calif. 92324

[22] Filed: Feb. 26, 1976

[21] Appl. No.: 661,744

[52] U.S. Cl. ..... 340/280; 200/51.1; 200/50 B; 340/421

[51] Int. Cl.[2] ..... G08B 13/02

[58] Field of Search ..... 340/280, 421; 200/51.1, 200/50 B, 61.59

[56] References Cited

UNITED STATES PATENTS

| | | | |
|---|---|---|---|
| 3,090,948 | 5/1963 | Cremer | 340/280 |
| 3,114,905 | 12/1963 | Sliman | 340/280 |
| 3,192,518 | 6/1965 | Sliman | 340/280 |
| 3,786,502 | 1/1974 | Stendig et al. | 340/280 |

*Primary Examiner*—Glen R. Swann, III
*Attorney, Agent, or Firm*—William C. Babcock

[57] ABSTRACT

An alarm system for indicating the unauthorized withdrawal of an appliance lead from a wall receptacle includes a spring biased arm extending partly through the ground connector opening of the receptacle against a microswitch. When the plug is in the receptacle the arm is displaced by the ground terminal of the plug away from the microswitch, opening the switch. The microswitch is connected in series with a master switch which, in turn, connects to an audio alarm. Upon withdrawal of the plug from the receptacle, the spring biasing forces of the arm direct the arm both across the ground terminal openings and against the micro-switch, closing the circuit to the alarm. Should the plug be removed, a slot is provided in the wall plate through which a key is insertable to withdraw the arm from the ground terminal opening, thus permitting reinsertion of the plug. In the alternative, the inventive alarm may include a latching relay, latched by the closure of the microswitch, and a master switch may be included in the circuit for on-off control.

7 Claims, 8 Drawing Figures

ALARM SYSTEM FOR ELECTRICAL RECEPTACLES

BACKGROUND OF THE INVENTION

1. Field of the Invention

The present invention relates to alarm devices, and more particularly to alarm devices adapted to indicate the unauthorized withdrawal of a plug from a wall socket.

2. Description of the prior art

With the present rise in crime, and particularly crime against property, various alarm devices for protection of property have been developed. Most such prior art alarm systems are directed at detecting unauthorized entry into a protected building and therefore entail various techniques for monitoring the places of egress and ingress. For this reason, most prior art alarm systems involve a large financial outlay and therefore have not been commonly accepted by the consumer. While such prior alarm systems do protect the whole building, very often the criminal entering the building does so for the purpose of removing conveniently portable items, such as portable appliances. Electrical appliances, in particular, typically represent a large investment to an average person and are furthermore conveniently packaged for portability and resale. Each such electrical appliance is usually connected to a wall receptacle, this connection being very rarely disrupted in normal use. The unauthorized taking of such portable appliances will therefore most often entail the withdrawal of the plug from the receptacle. Heretofore this particular feature has not been utilized to advantage in the prior art alarm systems.

In addition to the features set forth above, most present-day appliances include in their connecting interfaces, a three-terminal connection where the third terminal is normally the grounding terminal of the device. The receptacle is similarly provided with a ground contact, which, under proper circumstances, is essentially a zero potential. Any alarm mechanism utilizing this ground contact does not require any isolation or voltage protection.

SUMMARY OF THE INVENTION

Accordingly, it is the general purpose and object of the present invention to provide an alarm system articulated by the withdrawal of the grounding terminal from a wall socket.

Further objects of the invention are to provide a socket alarm system which precludes discontinuation of the alarm after an unauthorized withdrawal.

Yet further objects of the invention are to provide a socket alarm system which is convenient in use, easy to produce and economical in manufacture.

Briefly, these and other objects are accomplished within the present invention by connecting a spring-loaded arm to the frame of the receptacle, such arm extending through a transverse slot cut in the ground terminal opening. The free end of the arm is convolved to engage the tripping lever of a microswitch. The alignment of the microswitch relative the arm is such that switch closure will occur if the arm is free to translate across the interior of the ground opening. With the ground terminal in the receptacle, however, the arm is biased away from the tripping lever, opening the microswitch. This microswitch can then be connected in series with an audio alarm device which, furthermore, may include a latching relay so that subsequent reinsertion of the ground terminal will not turn off the alarm. To provide for authorized use, the face plate of the receptacle may include a key opening through which an arm articulating key can be inserted to bias the arm away from the ground and the circuit may include a master switch located in a place known only to the user.

DESCRIPTION OF THE SPECIFIC EMBODIMENT

While the following description illustrates in detail one implementation of the inventive concept, it is to be understood that various other implementations are possible and will be obvious to those skilled in the art. It is therefore intended that the scope of the invention be determined solely by the claims appended hereto and not by the choice of the following illustrations.

Figure 1:
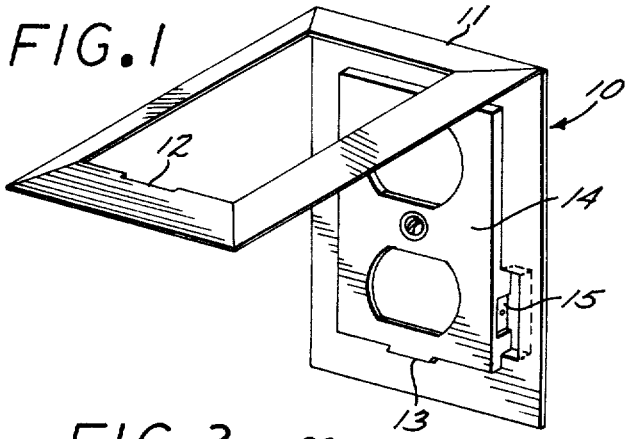
FIG. 1 is a perspective illustration of a face plate constructed for use with the present invention.

As shown in FIG. 1, a face plate assembly generally designated by the numeral 10 includes a hinged rectangular frame 11 conformed to the periphery of a wall receptacle. Frame 11, on the interior edge opposite the hinge, forms a latching recess 12 adapted to engage a latching projection 13 formed on the corresponding edge of a receptacle face plate 14. Formed further along a longitudinal edge of the face plate 14 is a key opening 15 for use with the invention disclosed herein.

Figure 2:
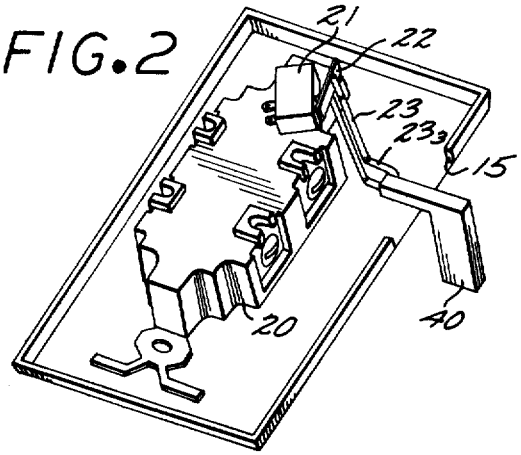
FIG. 2 is a perspective rear view of a conventional receptacle assembly modified according to the present invention.
Figure 3:
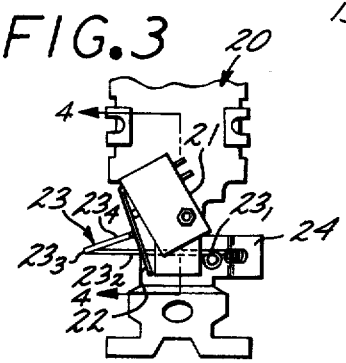
FIG. 3 is a detail rear view of the modifications shown generally in FIG. 2.
Figure 4:
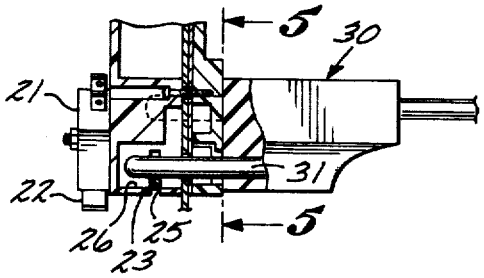
FIG. 4 is a side view, in section, taken along line 4—4 of FIG. 3.
Figure 5:
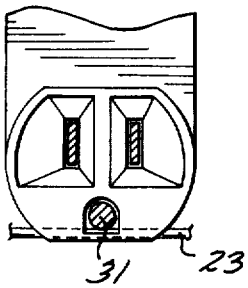
FIG. 5 is a receptacle front view taken along line 5—5 of FIG. 4.
Figure 7:
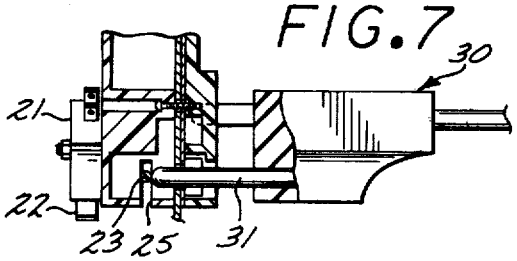
FIG. 7 is a sectional side view illustrating the detail of FIG. 4 after articulation of the arm.
Figure 6:
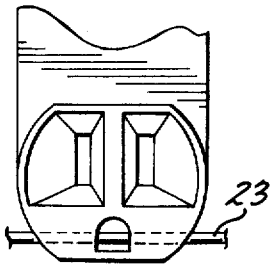
FIG. 6 is a receptacle front view demonstrating the position of the invention arm upon withdrawal of the plug.

As shown in FIGS. 2 and 3, a conventional wall receptacle assembly 20 is disposed beneath the face plate 14; receptacle assembly 20 being of the dual receptacle configuration each receptacle including three contact terminals, two for bringing out the electrical power and a third one connected to a common ground. Disposed on the underside of the receptacle 20 is a micro-switch 21 including a switching lever 22 aligned to be articulated by the free end of a spring-loaded arm 23 which extends as a beam from the ground plate 24 of the assembly 20. As shown in more detail in FIGS. 3–7, the body of the receptacle 20 is modified by a transverse slot 25 partly extending across the ground contact opening, shown herein as the opening 26. The disposition of arm 23 relative the receptacle 20 is such that in its free position the arm 23 will extend centrally across slot 25 and therefore across the ground opening 26. A conventional three terminal plug 30 thus cannot be inserted because of the interference of the ground terminal 31 with the received section of arm 23. In order to permit insertion of the terminals of plug 30 a key 40 shown in position in FIG. 2 is insertable through the key opening 15 to engage the free end of arm 23, thus allowing manual articulation of the arm out of its interfering alignment within slot 25 during the insertion of the plug. The point of insertion of the key 40 is normally hidden from view by the rectangular frame 11 which when closed mates continuously with the edges of the face plate 14, thus providing only a telltale indication of the modifications disclosed herein.

By reference back to FIGS. 2 and 3 once more the arm 23 is generally formed from a wire-like metallic structure secured at one end to the ground plate 24. A helical spring section $23_1$ immediately adjacent to the point of fixity of arm 23 provides for the required degree of spring flexure in the arm. Arm 23 extends beyond spring $23_1$ as a straight wire segment $23_2$ which is the same segment passing through slot 25. At the free end arm 23 is formed into a loop $23_3$ which is exposed immediately adjacent opening 15 for engagement with the key 40. Beyond loop $23_3$ a short return segment $23_4$ of the arm is provided for engagement with the switching lever 22.

In this form the conventional features available in any mass produced receptacle assembly are utilized to best advantage; in fact, the ground plate provides the necessary attachment point for the inventive arm. The helical spring $23_1$ in addition to the flexibility that it provides, also provides the necessary vertical displacement of the arm segment $23_2$ from the ground plate for aligning that segment within slot 25.

In the arrangement shown, only a single receptacle within the assembly is inventively modified, giving the user the option of using the other receptacle for intermittently connected plug-in devices not intended for protection. In the protected receptacle, withdrawal of the plug 30 will release the arm to align across the ground contact opening. Once released, switching lever 22 on microswitch 21 will close to excite an alarm.

Figure 8:
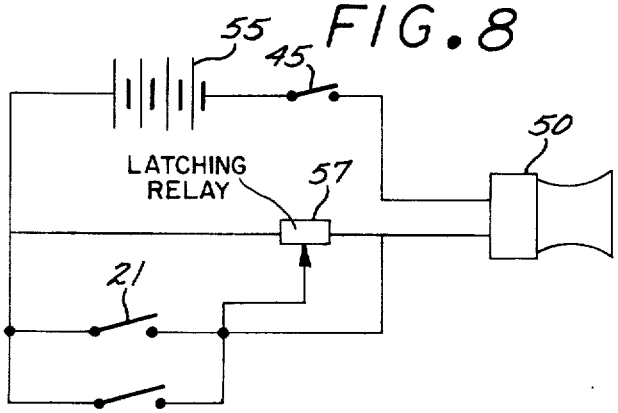
FIG. 8 is a circuit schematic illustrating the various switches shown about in an alarm circuit.

For the purposes herein, a circuit as shown in FIG. 8 may include a plurality of such microswitches 21 in parallel each microswitch protecting a particular appliance. This parallel switching arrangement is then connected in series with a master switch 45 which may be placed in a hidden location known only to the user. Closure of both switches, i.e. switches 21 and 45, then completes a circuit to an audio alarm 50 connected across a battery 55.

A latching relay 57 may be provided which, upon the articulation of any one of the switches 21, with latch to maintain excitation to the alarm 50 regardless of the subsequent corrections made by the intruder.

Some of the many advantages of the present invention should now be readily apparent. The invention provides by means simple to produce and convenient in installation, a protection system which is within the mechanical skills of a typical home user. Since the only interface is through the ground terminal of the outlet, no high voltages appear in the inventive system which is thus isolated from the home electrical power. In use, the inventive system can be left active for long periods of time, i.e., periods dictated by battery shelf life. In addition, the invention provides a large degree of flexibility over the various appliances protected, thus allowing the home user the freedom of selecting such number of protective devices as he finds necessary.

Obviously many modifications and variations to the above disclosure can be made without departing from the spirit of the invention. It is therefore intended that the scope of the invention be determined solely dependent on the claims hereto.

I claim:

1. In an electrical receptacle including two female terminals for electrical excitation and a female grounding terminal formed in a housing the improvement comprising:

a transverse slot formed partly across said grounding terminal;

a spring biased arm connected at one end thereof to said housing and arranged to align within said slot for intersecting said grounding terminal;

a switch connected to said housing and aligned to be closed by the free end of said arm when said arm is intersecting said grounding terminal and to be opened upon the displacement of said arm by an electrical connector insertable in said grounding terminal; and alarm means connected in circuit with said switch.

2. Apparatus according to claim 1 further comprising:

a key engaging projection formed on the free end of said arm for engagement with a key adapted to articulate said arm out of said slot to permit insertion of said electrical connector.

3. An alarm device adapted for monitoring the unauthorised removal of an electrical plug from an electrical receptacle comprising:

a transverse slot formed to partly extend across one terminal opening of said receptacle;

a normally open switch mounted on said receptacle;

a spring-loaded arm connected at one end to said receptacle and arranged to pass through said slot to close said switch at the free end thereof, said arm being adapted to be withdrawn from said switch concurrent with the insertion of said plug into said receptacle to be maintained in said withdrawn state by said plug; and alarm circuit means connected to said switch.

4. Apparatus according to claim 3 wherein:

said alarm circuit means further includes master switching means in series with said normally open switch.

5. Apparatus according to claim 4 wherein:

said normally open switch includes a normally open microswitch and a pivoted lever extending from said microswitch to engage said arm and to articulate said microswitch.

6. Apparatus according to claim 5 further comprising:

a key engaging projection formed on the free end of said arm for engagement with a key adapted to articulate on said arm out of said slot to permit insertion of said electrical plug.

7. Apparatus according to claim 3 further comprising:

latching relay means connected in circuit with said alarm circuit means and adapted to latch upon the closure of said normally open switch.

* * * * *